US008084699B2

(12) United States Patent
Eto

(10) Patent No.: US 8,084,699 B2
(45) Date of Patent: Dec. 27, 2011

(54) VEHICLE SWITCH

(75) Inventor: Hideaki Eto, Fukui (JP)

(73) Assignee: Panasonic Corporation, Osaka (JP)

( * ) Notice: Subject to any disclaimer, the term of this patent is extended or adjusted under 35 U.S.C. 154(b) by 393 days.

(21) Appl. No.: 12/423,120

(22) Filed: Apr. 14, 2009

(65) Prior Publication Data

US 2009/0260963 A1 Oct. 22, 2009

(30) Foreign Application Priority Data

Apr. 17, 2008 (JP) ..... 2008-107659

(51) Int. Cl.
*H01H 9/02* (2006.01)

(52) U.S. Cl. ..... 200/5 R; 200/293; 200/296; 200/300; 200/295

(58) Field of Classification Search ..... 200/4.5 R, 200/293–300; 248/27.1, 27.3, 548, 560, 248/573, 580, 581, 596, 602–604, 615, 618, 248/629, 346.01, 346.03, 346.04, 346.5
See application file for complete search history.

(56) References Cited

U.S. PATENT DOCUMENTS

| | | | | | |
|---|---|---|---|---|---|
| 3,993,884 | A | * | 11/1976 | Kondur et al. | 200/295 |
| 4,051,916 | A | * | 10/1977 | Oda | 180/90 |
| 4,112,282 | A | * | 9/1978 | Piber | 200/296 |
| 5,235,648 | A | * | 8/1993 | Yamamoto | 381/109 |
| 6,512,189 | B1 | * | 1/2003 | Schuberth et al. | 200/334 |
| 6,600,118 | B2 | * | 7/2003 | Altmann | 200/295 |
| 6,696,769 | B2 | * | 2/2004 | Lee et al. | 307/10.1 |

FOREIGN PATENT DOCUMENTS

| | | | |
|---|---|---|---|
| JP | 07201250 | A * | 8/1995 |
| JP | 08138480 | A * | 5/1996 |
| JP | 2003-308759 | | 10/2003 |

* cited by examiner

*Primary Examiner* — Michael Friedhofer
(74) *Attorney, Agent, or Firm* — Wenderoth, Lind & Ponack, L.L.P.

(57) ABSTRACT

A vehicle switch includes a switch unit formed of a wiring board and an operating unit placed over the wiring board, a housing accommodating the wiring board, and a supporting member elastically deformable and placed in the housing for supporting the wiring board. This structure prevents switch contacts and the wiring board from being damaged, even when a great load or shock is applied to the operating unit, so that the vehicle switch can be reliably operated.

17 Claims, 16 Drawing Sheets

VEHICLE SWITCH

FIELD OF THE INVENTION

The present invention relates to a vehicle switch to be used mainly for operating a variety of electronic devices installed in the interior of the car.

BACKGROUND OF THE INVENTION

In recent years, a vehicle switch mounted on the dashboard or near the steering wheel in the interior of the car has gained popularity because it is convenient for the driver to operate a variety of electronic devices such as an audio system or an air-conditioner. The vehicle switch is thus required to be easy to operate and to perform its function reliably.

A conventional vehicle switch disclosed in Unexamined Japanese Patent Application Publication No. 2003-308759 (Patent Document 1) is described hereinafter with reference to FIGS. 13-16. FIG. 13 shows a sectional view of the conventional vehicle switch, and FIG. 14 shows an exploded perspective view of this conventional vehicle switch. In FIGS. 13 and 14, vehicle switch 11 comprises the following elements:

a disk-like wiring board 1 made of insulating resin; and encoder 2 working as a switch contact of a rotary-switch and placed approximately at the center of wiring board 1.

Multiple wiring patterns (not shown) are formed on both the faces of wiring board 1. Push switch 3 working as a switch contact of a push-switch is mounted in hollow cylinder 2A of encoder 2.

Operating unit 4 shaped like a cylinder with an opening at its center and made of insulating resin is mounted to rotary operating section 2B formed on an upper section of encoder 2. Push button 5 shaped like a cylinder and made of insulating resin is accommodated in the opening of operating unit 4 such that it can move up and down.

As discussed above, various electronic components such as encoder 2 and push switch 3 are mounted on wiring board 1. Switch unit 10 is thus formed of wiring board 1, encoder 2, push-switch 3, operating unit 4, and push button 5. A rotation of operating unit 4 prompts encoder 2 to perform an electrical switch-on or switch-off. A push onto push button 5 depresses push-switch 3 via pressing section 5A, whereby push-switch 3 performs an electrical switch-on or switch-off.

Housing 6 shaped like a cylindrical box with a bottom plate and made of insulating resin includes multiple fixing sections 6A at its inner wall, and each one of fixing sections 6A protrudes inward. Wiring board 1 of switch unit 10 is placed on fixing sections 6A. Wiring board 1 has multiple cutouts 1A corresponding to fixing sections 6A, and is screwed to fixing sections 6A with screws 7, so that switch unit 10 is fixed to housing 6. Operating unit 4 placed on housing 6 is covered with cylindrical cover 8 at its outer wall, and cover 8 is mounted on the top face of housing 6, whereby vehicle switch 11 is constructed.

The foregoing vehicle switch 11 is mounted on the dashboard or near the steering wheel in the car interior with operating unit 4 protruding forward. When operating unit 4 is operated by a driver, encoder 2 or push-switch 3 is connected electrically to an electronic circuit (not shown) of the car via the wiring patterns, switch contacts, connectors and lead wires (not shown) of wiring board 1.

A downward push onto push-button 5 with a finger lowers push-button 5, and a lower end of pressing section 5A depresses push-switch 3, so that push-switch 3 can perform an electrical switch-on or switch-off. An electrical signal generated by this switch-on or switch-off is supplied to the electronic circuit of the car, thereby turning on or off the power supply of, e.g. the audio system or the air-conditioner.

When the operating unit 4 protruding upward from cover 8 is held with fingers, and rotated, rotating section 2B of encoder 2 rotates in synchronization with the rotation of operating unit 4. An electrical switch-on or switch-off of the inner switch contact is repeated in response to a rotation amount of rotating section 2B, and an electrical signal generated by this switch-on or switch-off is supplied to the electronic circuit of the car, thereby increasing or decreasing a sound volume of the audio system or a temperature of the air-conditioner.

Operating unit 4 generally protrudes from the top face of cover 8 by 20-30 mm to be held and rotated easily with fingers. Baggage in the car interior sometimes hits this protrusion, so that a large load or shock is applied to operating unit 4 or push-button 5, thereby damaging encoder 2, push-switch 3 or wiring board 1. Switch unit 10 as a whole thus sometimes subsides into housing 6.

Problems of the conventional vehicle switch are described hereinafter with reference to FIG. 13 and FIG. 15A-FIG. 16B. FIGS. 15A and 15B show sectional views illustrating the operation of the conventional vehicle switch. FIG. 15B shows a status where a greater load or shock is applied to operating unit 4 or push-button 5 than a load or a shock applied to them shown in FIG. 15A. FIGS. 16A and 16B show perspective views illustrating the operation of the conventional vehicle switch. FIG. 16A shows a normal status, and FIG. 16B shows the status where a greater load or shock is applied to operating unit 4 or push-button 5 than a load or a shock applied to them in the normal status shown in FIG. 16A. To be more specific, when baggage in a car interior hits operating unit 4 or push button 5, and a large load or shock is applied to operating unit 4 or push button 5, then the normal status shown in FIG. 13 or FIG. 16A changes to the status shown in FIG. 15A, where crack 1D occurs on wiring board 1. Encoder 2 or push-switch 3 can be cracked depending on the magnitude or the direction of the load or the shock. When the greater load or shock than the foregoing case is applied to operating unit 4 or push button 5, wiring board 1 is broken near fixing section 6A of housing 6, and then as shown in FIG. 15B and FIG. 16B, switch unit 10 as a whole sometimes subsides into housing 6.

A user can operate various devices installed in the car interior by rotating operating unit 4 or pressing push button 5 of vehicle switch 11 mounted on the dashboard or near the steering wheel of the car. However, when a large load or shock is applied to operating unit 4 or push button 5, encoder 2 or push switch 3 of switch unit 10, or wiring board 1 including switch contacts tends to be broken.

SUMMARY OF THE INVENTION

The present invention addresses the problems discussed above, and aims to provide a vehicle switch that can prevent its encoder or wiring board of the switch unit from being broken even if a large load or shock is applied to the operating unit or the push button. The vehicle switch also performs its function reliably.

The vehicle switch of the present invention comprises the following elements:

a wiring board accommodated in a housing;

an operating unit disposed rotatably over the wiring board a switch contact that is formed on a top face of the wiring board, and performs an electrical switch-on or switch-off in response to a rotation amount of the operating unit; and an elastically deformable supporting member accommodated in the housing for supporting the wiring board.

The foregoing structure prevents the encoder or the wiring board including switch contacts from being damaged even if a large load or shock is applied to the operating unit, and allows the vehicle switch to perform the functions reliably.

BRIEF DESCRIPTION OF THE DRAWINGS

FIG. 6 shows an exploded perspective view of the vehicle switch shown in

FIG. 5.

DESCRIPTION OF PREFERRED EMBODIMENTS

Exemplary Embodiment 1

Figure 1:
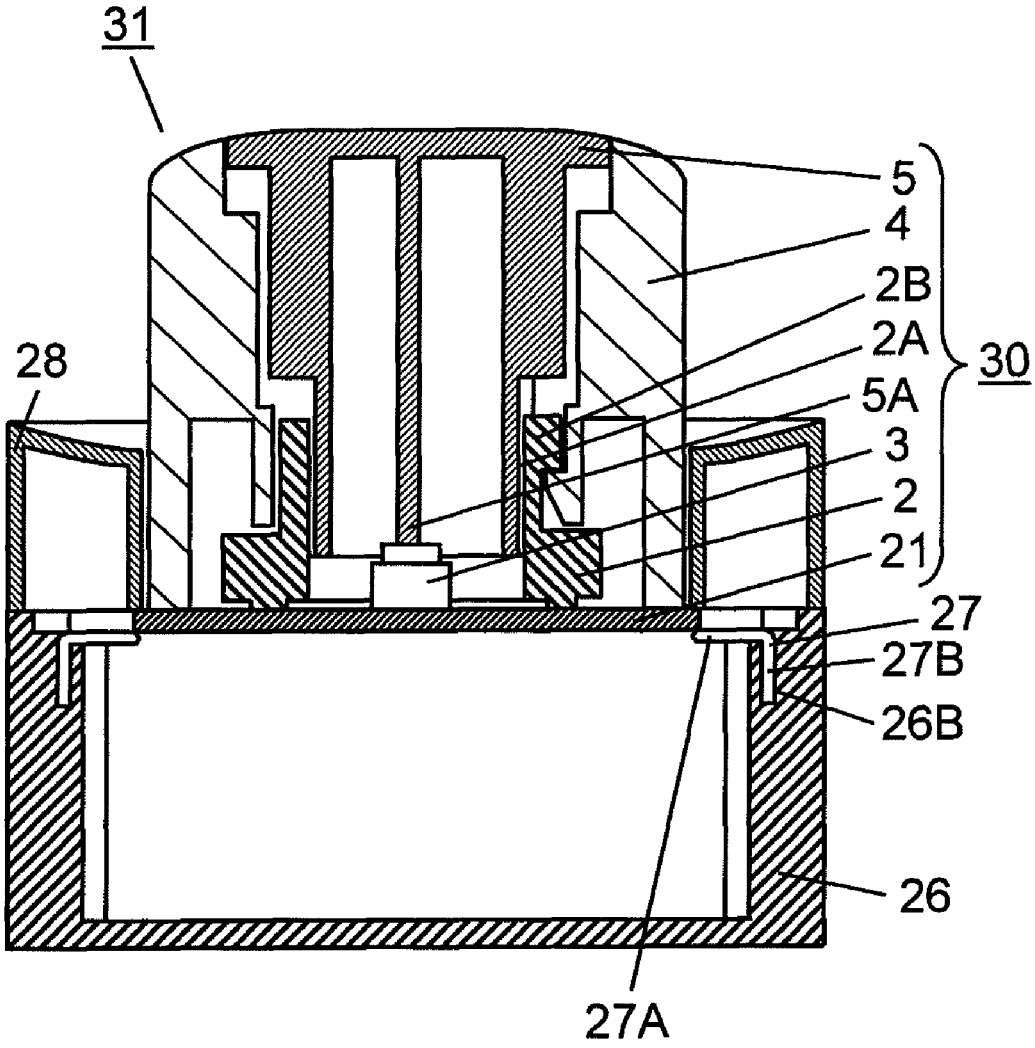
FIG. 1 shows a sectional view of a vehicle switch in accordance with a first embodiment of the present invention.
Figure 2:
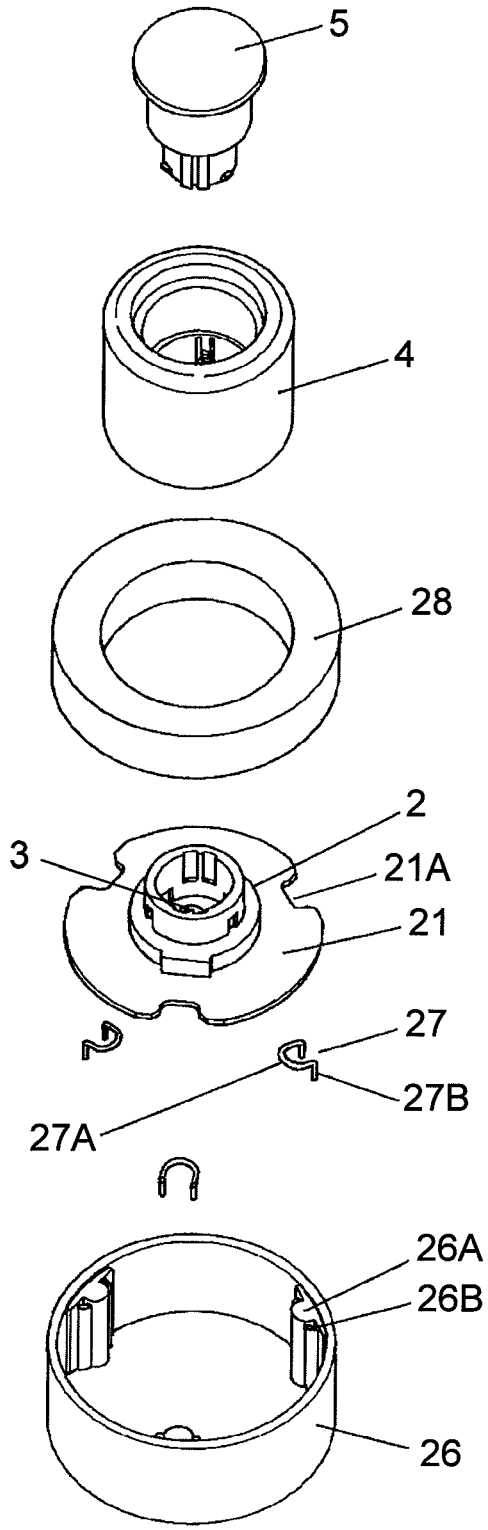
FIG. 2 shows an exploded perspective view of the vehicle switch shown in FIG. 1.

The first embodiment of the present invention is demonstrated hereinafter with reference to FIGS. 1-4B. FIG. 1 shows a sectional view of a vehicle switch in accordance with the first embodiment of the present invention, and FIG. 2 shows an exploded perspective view of the vehicle switch shown in FIG. 1. In FIGS. 1 and 2, vehicle switch 31 comprises the following elements:

wiring board 21 shaped like a disk and made of insulating resin such as paper phenol resin, or epoxy resin containing glass; and encoder 2 working as a switch contact of a rotary switch. Multiple wiring patterns (not shown) are formed on a top face and an underside of wiring board 21. Encoder 2 is mounted approx. at the center of wiring board 21. Push switch 3 working as a switch contact is mounted in hollow cylinder 2A of encoder 2. Operating unit 4 is mounted to rotary operating section 2B formed at an upper section of encoder 2, and it is shaped like a cylinder with an opening at its center and made of insulating resin such as acryl acrylonitrile butadiene styrene (ABS) or polycarbonate (PC). Push button 5 shaped like a cylinder and made of insulating resin such as ABS or PC is accommodated in the opening of operating unit 4 such that it can move up and down. Pressing section 5A formed at the lower end of push button 5 is brought into contact with push-switch 3 having switch contacts therein. Switch unit 30 is thus formed of wiring board 21, encoder 2, push-switch 3, operating unit 4, and push button 5.

As discussed above, various electronic components such as encoder 2 andpush-switch 3 are mounted on wiring board 21. Operating unit 4 is disposed above wiring board 21. Rotation of operating unit 4 prompts encoder 2 to perform an electrical switch-on or switch-off. A push onto push button 5 depresses the switch contact of push-switch 3 via pressing section 5A, whereby push-switch 3 performs an electrical switch-on or switch-off.

Housing 26 is shaped like a cylindrical box with a bottom plate and made of insulating resin such as ABS, polyoxymethylene (POM), or polybutylene terephthalate (PBT). Housing 26 includes multiple fixing sections 26A on its inner wall. Fixing sections 26A protrude inward, and are placed at equidistant intervals therebetween.

Support spring 27 working as a supporting member is formed of supporter 27A shaped like letter U and holders 27B formed on both the ends of supporter 27A and bent downward. Spring 27 is made of elastic metal wire such as hard steel wire, piano wire or stainless steel wire. Holders 27B are inserted into holding holes 26B formed on both sides of fixing section 26A of housing 26. Multiple support springs 27 are held by respective fixing sections 26A of housing 26.

Wiring board 21 has cutouts 21A corresponding to each one of fixing sections 26A, and each cutout 21A is slightly greater than fixing section 26A. The inside of each one of cutout 21A is brought into contact with supporter 27A of support spring 27 protruding inward of housing 26, so that wiring board 21 is supported on multiple support springs 27.

Cover 28 is shaped like a cylinder and made of insulating resin such as ABS or PC, and covers the outer wall of operating section 4 placed above housing 26. Cover 28 is mounted to housing 26 such that cover 28 prevents wiring board 21 from rotating. For instance, pins protrude downward from cover 28, wiring board 21 is provided with at least two holes, and the pins are inserted in the holes, such that cover 28 cannot be rotated.

Vehicle switch 31 thus constructed is mounted on the dashboard or near the steering wheel in the car interior with operating unit 4 protruding forward. When operating unit 4 is operated by a driver, encoder 2 or push-switch 3 is connected to an electronic circuit (not shown) of the car via the wiring patterns, switch contacts, connectors and lead wires (not shown) of wiring board 21.

A downward push onto push-button 5 with a finger lowers push-button 5, and prompts pressing section 5A at the lower end to depress an operating section of push-switch 3, so that push-switch 3 can perform an electrical switch-on or switch-off. An electrical signal generated by this switch-on or switch-off is supplied to the electronic circuit of the car, thereby turning on or off the power supply of, e.g. the audio system or the air-conditioner.

The operating unit 4 protruding upward from cover 28 is held with fingers, and rotated, and rotating section 2B of encoder 2 rotates in synchronization with the rotation of operating unit 4. An electrical switch-on or switch-off of the inner switch-contact is repeated in response to a rotation amount of rotating section 2B, and an electrical signal generated by this switch-on or switch-off is supplied to the electronic circuit of the car, thereby increasing or decreasing, e.g. a sound volume of the audio system or a temperature of the air-conditioner.

As discussed above, the driver can operate various devices installed in the car interior by rotating operating-unit 4 or pressing push-button 5 of vehicle switch 31 mounted on the dashboard or near the steering wheel of the car. Operating unit 4 generally protrudes from the top face of cover 28 by 20-30 mm to be held and rotated easily with fingers.

Figure 3A:
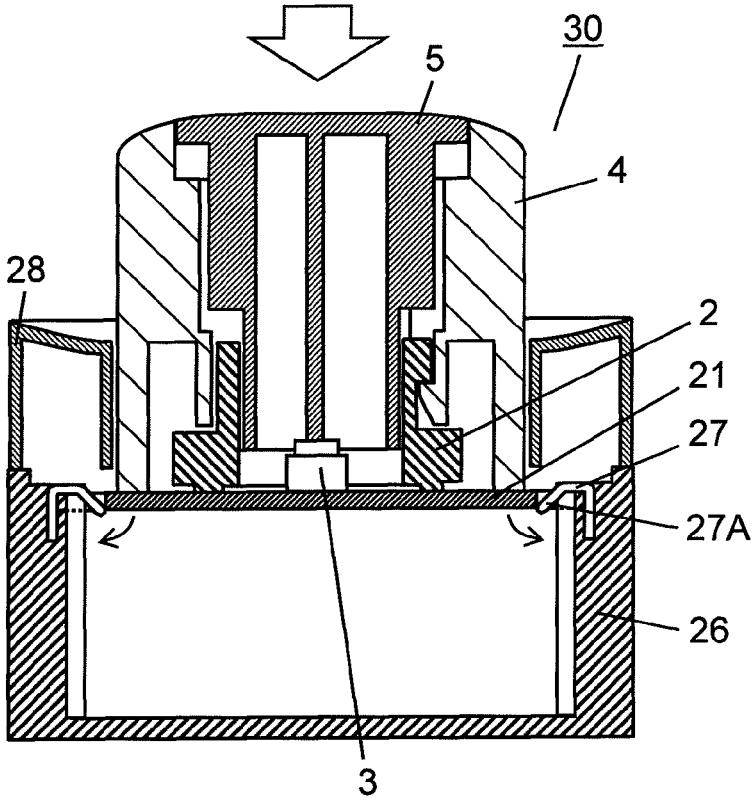
FIGS. 3A and 3B show sectional views illustrating operation of the vehicle switch shown in FIG. 1.
Figure 3B:
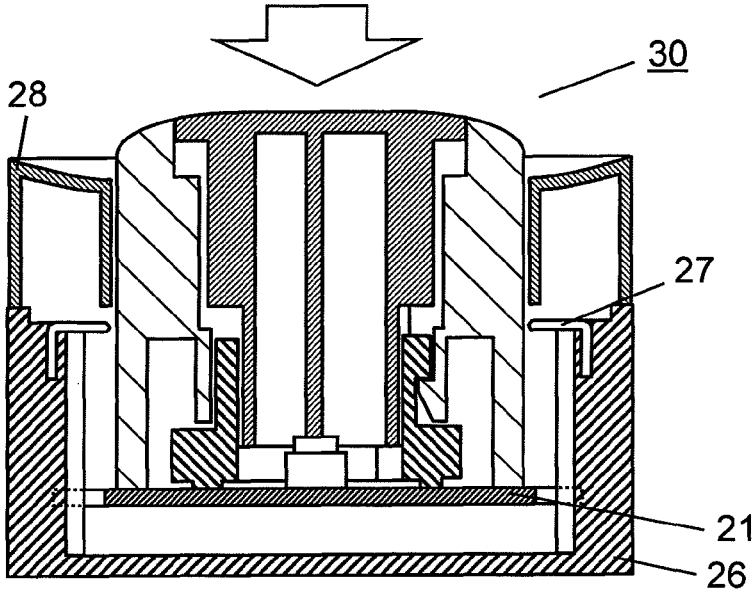
Figure 4A:
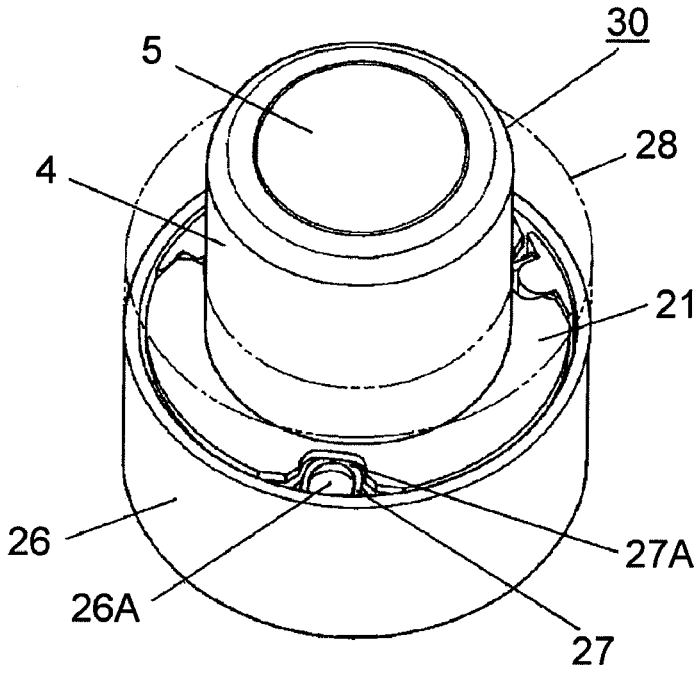
FIGS. 4A and 4B show perspective views illustrating operation of the vehicle switch shown in FIG. 1.
Figure 4B:
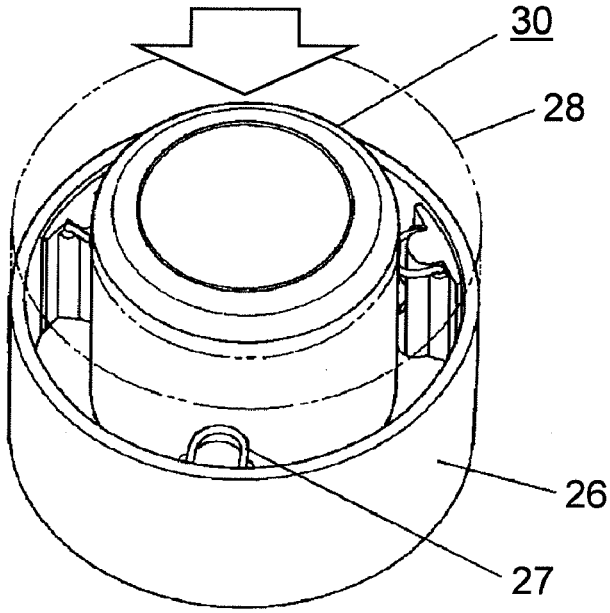

Operation of vehicle switch 31 in accordance with the first embodiment is demonstrated hereinafter with reference to FIGS. 3A-4B. FIGS. 3A and 3B show lateral sectional views of vehicle switch 31 to which a shock is applied. FIGS. 4A and 4B show perspective views of vehicle switch 31 in a normal status and a status where a shock is applied.

When baggage in the car interior hits operating unit 4 or push button 5, and a load or a shock greater than a given value is applied to operating unit 4 or push button 5, then the structure of switch 31 changes from the normal status shown in FIG. 1 or FIG. 4A to the status shown in FIG. 3A. To be more specific, wiring board 21 of switch unit 30 is depressed downward, which entails a downward bend (refer to arrow marks with a fine line in FIG. 3A) of supporters 27A of respective support springs 27 which support wiring board 21. This mechanism alleviates the load or shock applied to encoder 2, push-switch 3 and wiring board 21. The white arrow mark in FIG. 3A indicates the load or shock greater than a given value.

If the force greater than, e.g. 20 kgf, is applied to wiring board 21, wiring board 21 comes off support springs 27, and switch unit 30 lowers into the space within housing 26 of switch unit 30, as shown in FIGS. 3B and 4B. The white arrow marks shown in FIGS. 3B and 4B indicate the load or shock greater than 20 kgf.

To be more specific, when push button 5 is normally depressed, or operating unit 4 is normally rotated, switch unit 30 is supported by support springs 27 via wiring board 21 so that no obstruction can occur during the operation. However, when a greater force than a given value is applied to operating unit 4 or push button 5, support springs 27 are elastically deformed so that the load or shock can be alleviated. If a further greater force is applied as a load or a shock thereto, the support to wiring board 21 by support springs 27 is released, so that switch unit 30 lowers into a space in housing 26. This mechanism prevents switch unit 30 including encoder 2, push switch 3 and wiring board 21 from being damaged.

Since encoder 2, push switch 3 and wiring board 21 of switch unit 30 lowered into housing 26 are not damaged, operating unit 4 or push button 5 can still be depressed or rotated although these operations become rather cumbersome. The audio system or the air-conditioner can thus be reliably operated with this push or rotation.

If necessary, switch unit 30 lowered into housing 26 can be restored onto support springs 27 mounted at the upper section of housing 26, so that switch unit 30 is returned to the normal status. As a result, the user can use vehicle switch 31 again.

In the first embodiment discussed above, wiring board 21 of switch unit 30 accommodated in box-like housing 26 is supported by multiple support springs 27 held by housing 26 and made of elastic metal wire. When a great load or shock is applied to operating unit 4 or push button 5, this structure allows support-springs 27, which support wiring board 21, to be elastically deformed for alleviating the load or the shock. If a further greater load or shock is applied thereto, wiring board 21 comes off support-springs 27, so that switch contacts of encoder 2, push switch 3, and wiring board 21 are free from this greater load or shock. Vehicle switch 31 in accordance with this first embodiment prevents the electronic components such as encoder 2 and push switch 3 from being damaged, and thus reliable operation can be expected.

In this first embodiment, each support spring 27 is shaped like letter U and made of elastic metal wire. This structure allows for setting of the force to elastically deform spring 27 with ease, so that the supporting member can be manufactured in a simple structure with ease. On top of that, support springs 27 are inserted into holding holes 26B of housing 26 so that springs 27 can be held. This structure allows vehicle switch 31 to be assembled in a simple manner at a lower cost.

Exemplary Embodiment 2

Figure 5:
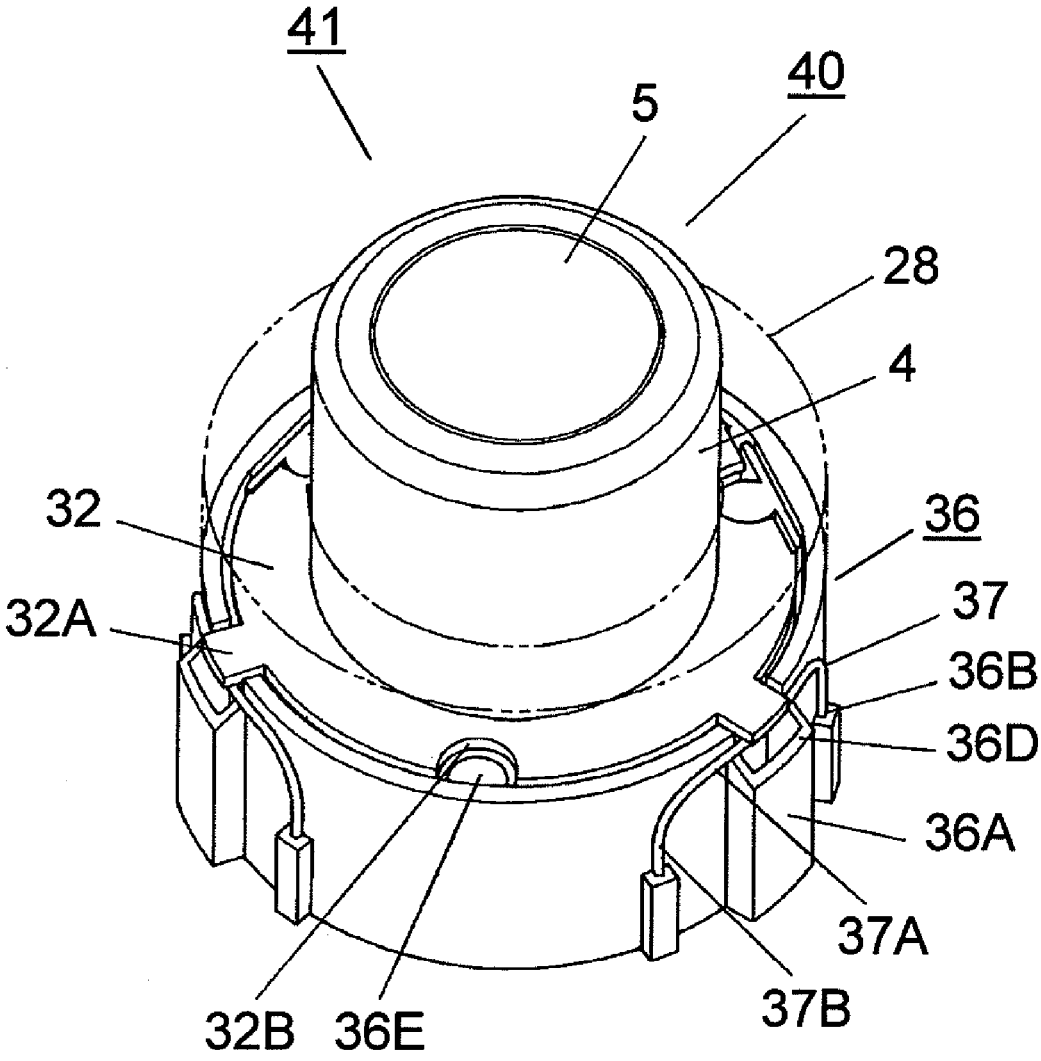
FIG. 5 shows a perspective view of a vehicle switch in accordance with a second embodiment of the present invention.
Figure 6:
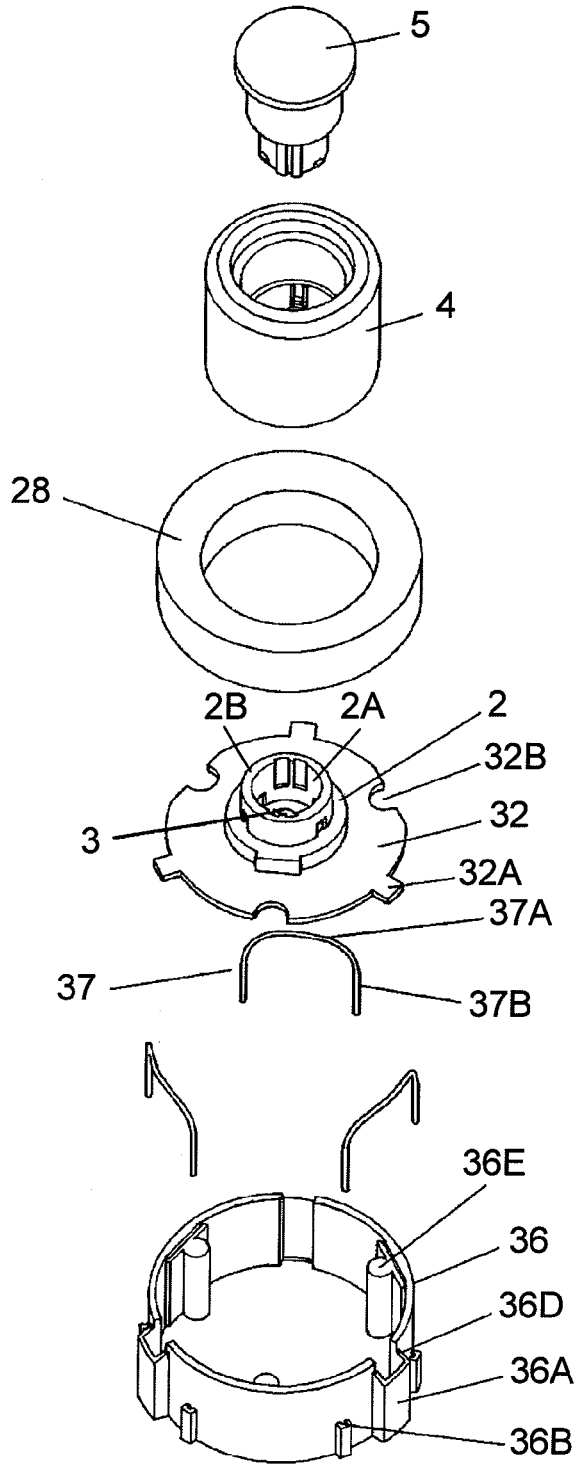

The second exemplary embodiment is demonstrated hereinafter with reference to FIGS. 5-7B. Elements similar to those used in the first embodiment have the same reference marks, and detailed descriptions thereof are omitted. FIG. 5 shows a perspective view of a vehicle switch in accordance with the second embodiment, and FIG. 6 shows an exploded perspective view of the same vehicle switch. In FIGS. 5 and 6, similar to the first embodiment, encoder 2 working as a switch contact of a rotary switch is mounted approximately at the center of disk-like wiring board 32 made of insulating resin. Push switch 3 working as a switch contact of a push switch is mounted in hollow cylinder 2A of encoder 2. Operating unit 4 is mounted to rotary operating section 2B formed on an upper section of encoder 2. In other words, operating unit 4 is placed above wiring board 32. Rotation of operating unit 4 carries out an electric switch-on or switch-off of the switch contact placed in encoder 2, and a push onto push button 5 accommodated in an opening formed at the center of operating unit 4 carries out an electric switch-on or switch-off of the switch contact of push-switch 3. As discussed above, encoder 2, push-switch 3 and others are mounted on wiring board 32. Switch unit 40 is thus formed of wiring board 32, encoder 2, push-switch 3, operating unit 4, and push button 5.

In this second embodiment, multiple stoppers 32A are formed on the circumference of wiring board 32 at three places or more than three places. Stoppers 32A protrude outward and are placed at equidistant intervals therebetween. Multiple fixing sections 36A shaped like letter U protruding outward and corresponding to stoppers 32A are formed on the outer wall of box-like housing 36 made of insulating resin. Each one of fixing sections 36A includes slant face 36D at its upper section, and face 36D slants downward and outward.

Support spring 37 working as a supporting member is formed of supporter 37A shaped like letter U and holders 37B formed on both the ends of supporter 37A and bent downward. Spring 37 is made of elastic metal wire such as hard steel wire, piano wire or stainless steel wire. Holders 37B are inserted into holding holes 36B formed on both sides of fixing section 36A of housing 36. Support springs 37 are thus held respectively by fixing sections 36A of housing 36.

Cutouts 32B of wiring board 32 are placed correspondingly to inner projections 36E formed on the inner wall of housing 36. Each stopper 32A formed on wiring board 32 is brought into contact with supporter 37A formed at the approximate center of each one of support springs 37. This structure allows support springs 37 to support wiring board 32.

Cover 28 covers the outer wall of operating section 4 placed above housing 36. Cover 28 is mounted to housing 36 such that cover 28 prevents wiring board 32 from rotating.

In this second embodiment, each support spring 37 working as a supporting member is held in fixing section 36A of holding hole 36B formed on the outer wall of housing 36, but not on the inner wall thereof. On top of that, stoppers 32A formed on wiring board 32 are brought into contact with supporters 37A, so that wiring board 32 is supported by support springs 37.

Similar to the first embodiment, vehicle switch 41 thus constructed is mounted on the dashboard or near the steering wheel in the car interior with operating unit 4 protruding forward. Encoder 2 and push-switch 3 are electrically connected to an electronic circuit (not shown) of the car. A push onto push-button 5 or a rotation of operating unit 4 allows for operation of electronic devices such as the audio system or the air-conditioner.

Figure 7A:
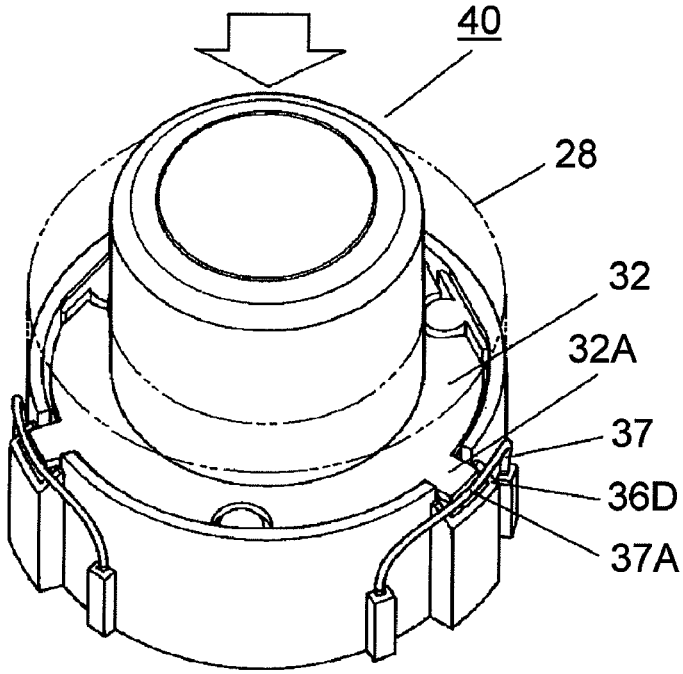
FIGS. 7A and 7B show perspective views illustrating operation of the vehicle switch shown in FIG. 5.

In this second embodiment, with vehicle switch 41 in the normal status as shown in FIG. 5, when baggage in the car compartment hits operating unit 4 or push button 5, and a load or a shock greater than a given force is applied to operating unit 4 or push button 5, wiring board 32 of switch unit 40 is depressed downward, which prompts supporters 37A of support springs 37 that support wiring board 32 to bend outward and downward along slant faces 36D as shown in FIG. 7A. This mechanism alleviates the load or shock applied to encoder 2, push switch 3 and wiring board 32.

Figure 7B:
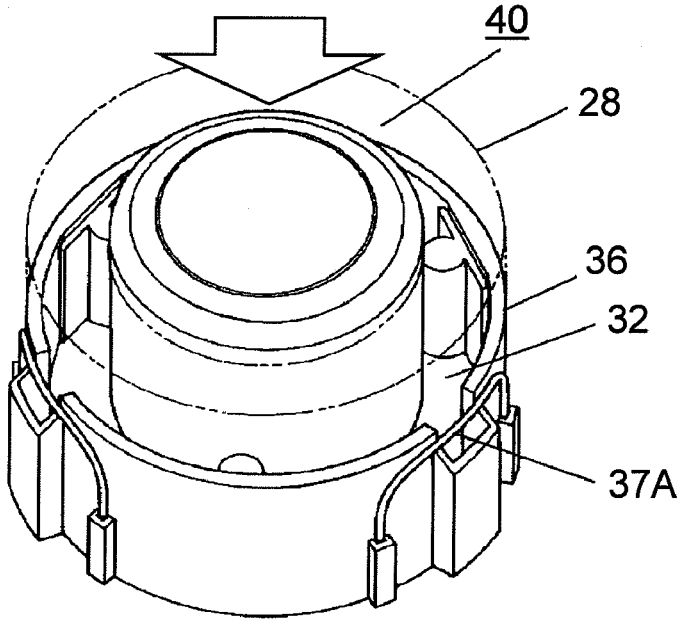

On top of that, if a force greater than 20 kgf is applied to operating unit 4 or push button 5, stoppers 32A come off supporters 37A as shown in FIG. 7B, so that the support to wiring board 32 by support springs 37 is released. Then switch unit 40 lowers into a space within housing 36. As a result, the foregoing structure can prevent encoder 2, push switch 3, and wiring board 32 of switch unit 40 from being damaged.

In the second embodiment discussed above, wiring board 32 of switch unit 40 accommodated in box-like housing 36 is supported by multiple support springs 37 held by housing 36 and made of elastic metal wire. When a great load or shock is applied to operating unit 4 or push button 5, this structure allows support springs 37, which support wiring board 32, to be elastically deformed outward for alleviating the load or the shock. If a further greater load or shock is applied thereto, wiring board 32 comes off support springs 37, so that switch contacts of encoder 2, push switch 3, and wiring board 32 are free from this greater load or shock. Vehicle switch 41 in accordance with this second embodiment prevents the electronic components such as encoder 2 and push switch 3 from being damaged. As a result, this second embodiment can provide reliable vehicle switch 41 as the first embodiment can.

In this second embodiment, supporters 37A of support springs 37 are brought into contact with slant faces 36D formed on the upper sections of fixing sections 36A of housing 36 while supporters 37A support stoppers 32A of wiring board 32. This structure allows each one of support springs 37 to be guided by slant face 36D, and respective springs 37 tend to expand outward equally. This structure allows the dispersion of the force to be smaller when the support to wiring board 32 by support springs 37 is released.

Exemplary Embodiment 3

Figure 8:
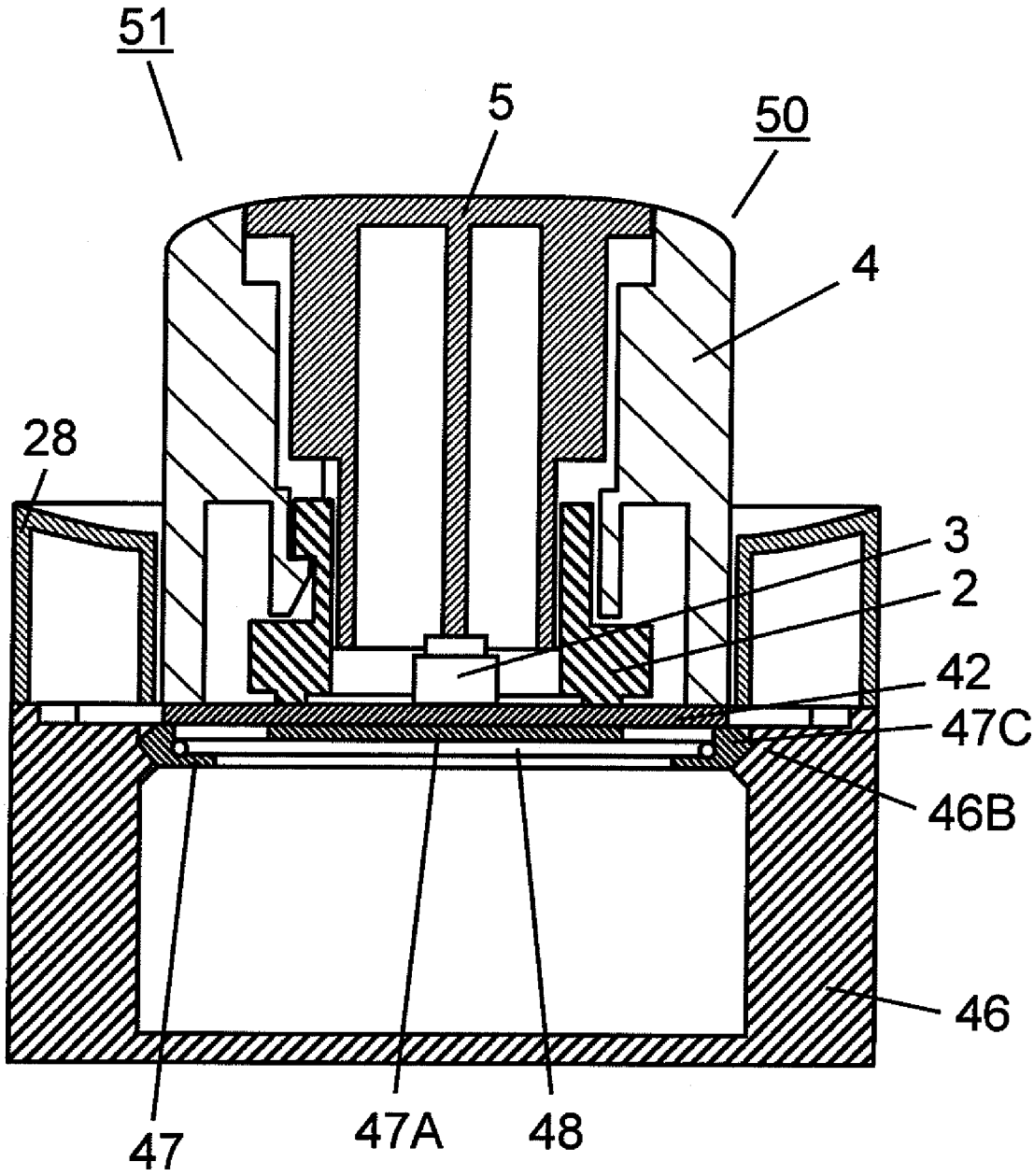
FIG. 8 shows a sectional view of a vehicle switch in accordance with a third embodiment of the present invention.
Figure 9:
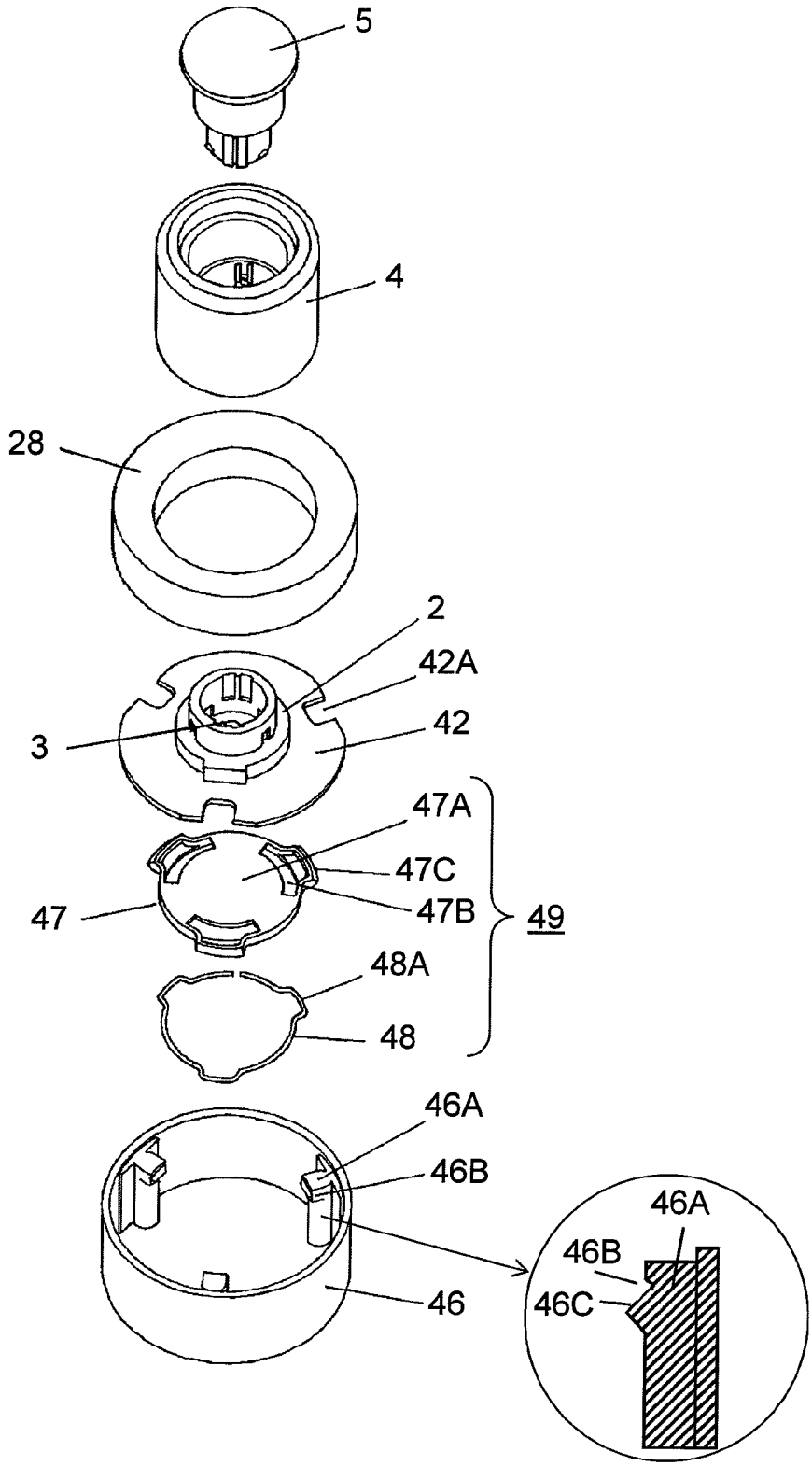
FIG. 9 shows an exploded perspective view of the vehicle switch shown in FIG. 8.

The third exemplary embodiment is demonstrated hereinafter with reference to FIGS. 8-12B. Elements similar to those used in the first or second embodiment have the same reference marks, and detailed descriptions thereof are omitted. FIGS. 8 and 9 show a sectional view and an exploded perspective view of a vehicle switch in accordance with the third embodiment. In FIGS. 8 and 9, similar to the first embodiment, encoder 2 and push switch 3 are mounted on disk-like wiring board 42. Operating unit 4 and push button 5 are placed over encoder 2 and push switch 3 such that they can be operated, whereby switch unit 50 is formed. Switch unit 50 is thus formed of wiring board 42, encoder 2, push-switch 3, operating unit 4, and push button 5. Box-like housing 46 is placed beneath switch unit 50, and cylindrical cover 28 covers the outer wall of operating unit 4 placed on housing 46. In this third embodiment, disk-like support board 47 is placed beneath wiring board 42, and support board 47 is made of insulating resin, having high elasticity and shock resistance, such as ABS, PC, rubber or elastomer.

Figure 10:
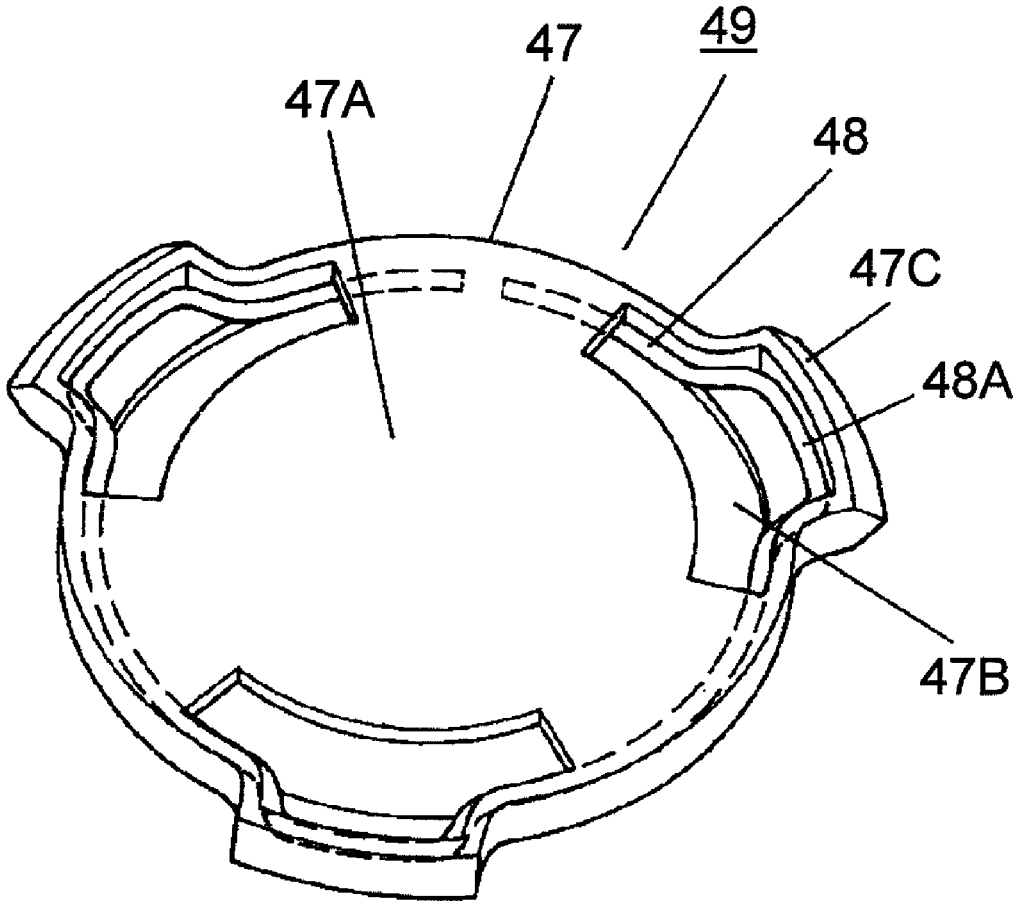
FIG. 10 shows a perspective view illustrating an essential part of the vehicle switch shown in FIG. 8.

Flat support-face 47A forms at the center of the top face of support board 47. Support-board 47 includes multiple arc-shaped slits 47B formed near its outer circumference and multiple engaging sections 47C formed outside slits 47B and projecting outward. Circular support spring 48 is mounted to support board 47, and spring 48 is made of elastic metal wire such as hard steel wire, piano wire or stainless steel wire. To be more specific, as shown in FIG. 10 which is a perspective view illustrating an essential part of switch unit 50, protrusions 48A projected outward of support spring 48 are elastically urged against the inner walls of engaging sections 47C. Support-board 47 and support-spring 48 thus form elastically deformable supporting member 49.

Each engaging section 47C of support-board 47 protrudes like letter U outside slit 47B, so that it is elastically deformable inward by the force applied thereto from the outside. Since support spring 48 is mounted inside support-board 47, protrusion 48A slightly vows and urges against engaging section 47C from the inside. This structure reinforces the outward elasticity of engaging section 47C.

At least three fixing sections 46A are provided on the inner wall of housing 46. Each fixing section 46A is shown with its cross section partially enlarged in the circle shown in FIG. 9, and each stopper recess 46B is shown forming a recess formed of the upper inside section of fixing section 46A and slant face 46C extending from the upper inside section. Each engaging section 47C of support-board 47 elastically urges against stopper recess 46B formed on the upper inside of fixing section 46A, so that supporting member 49 is held by housing 46. Thus, support-board 47 is held by fixing section 46A.

Cutouts 42A of wiring board 42 are placed correspondingly to fixing sections 46A of housing 46. Supporting member 49 supports wiring board 42 of switch unit 50. Vehicle switch 51 is thus constructed.

As discussed above, support spring 48 is mounted to support-board 47, so that elastically deformable supporting member 49 can be formed, and this supporting member 49 is held on the inner wall of housing 46 for supporting wiring board 42.

Similar to the first and the second embodiments, vehicle switch 51 discussed above is mounted to a given place in the car interior, and a push onto push button 5 or a rotation of operating unit 4 operates various electronic devices installed in the car interior.

Figure 11A:
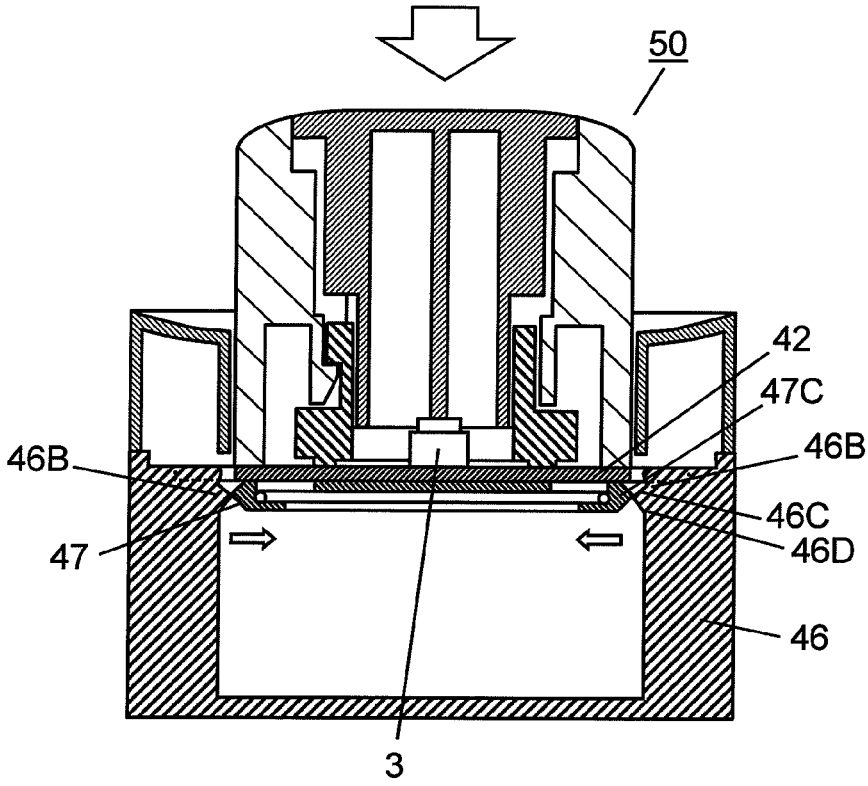
FIGS. 11A and 11B show sectional views illustrating operation of the vehicle switch shown in FIG. 8.
Figure 11B:
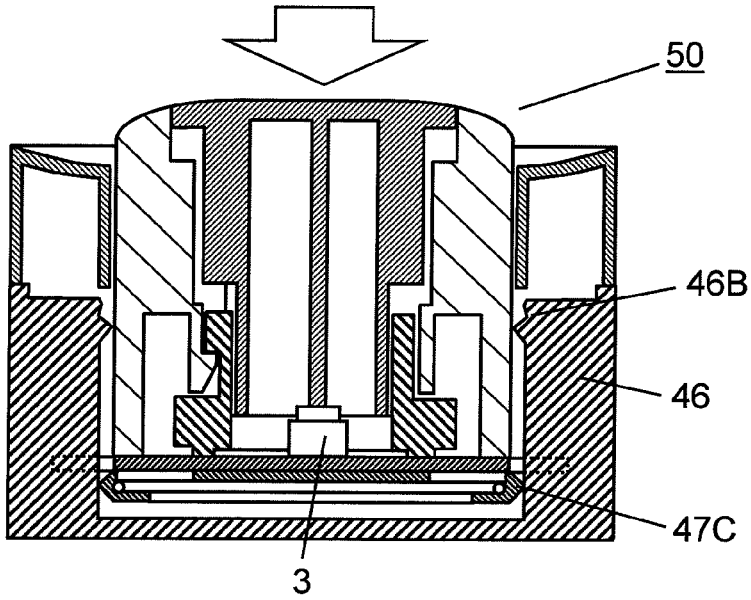
Figure 12A:
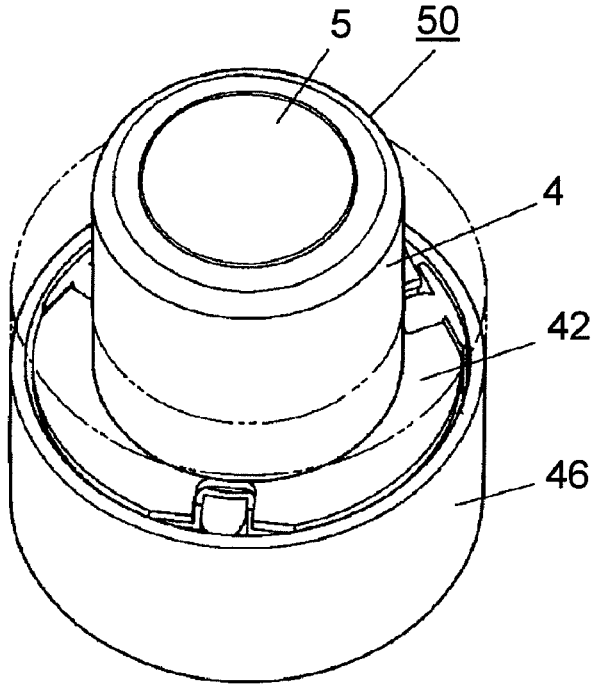
FIGS. 12A and 12B show perspective views illustrating operation of the vehicle switch shown in FIG. 8.
Figure 12B:
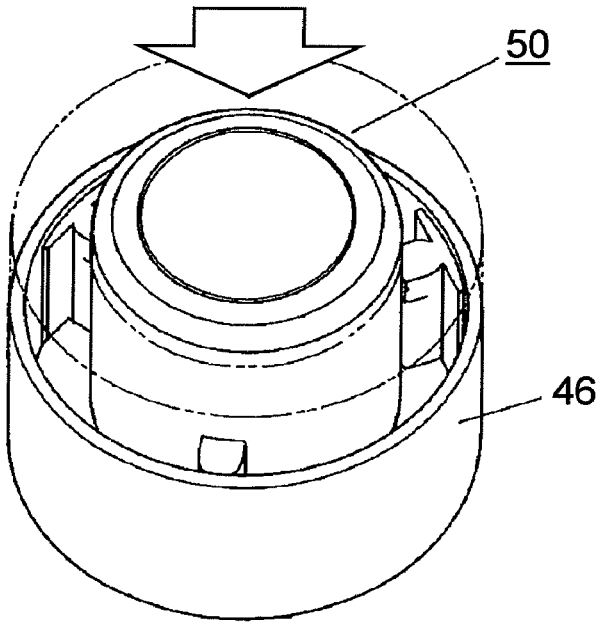
Figure 13:
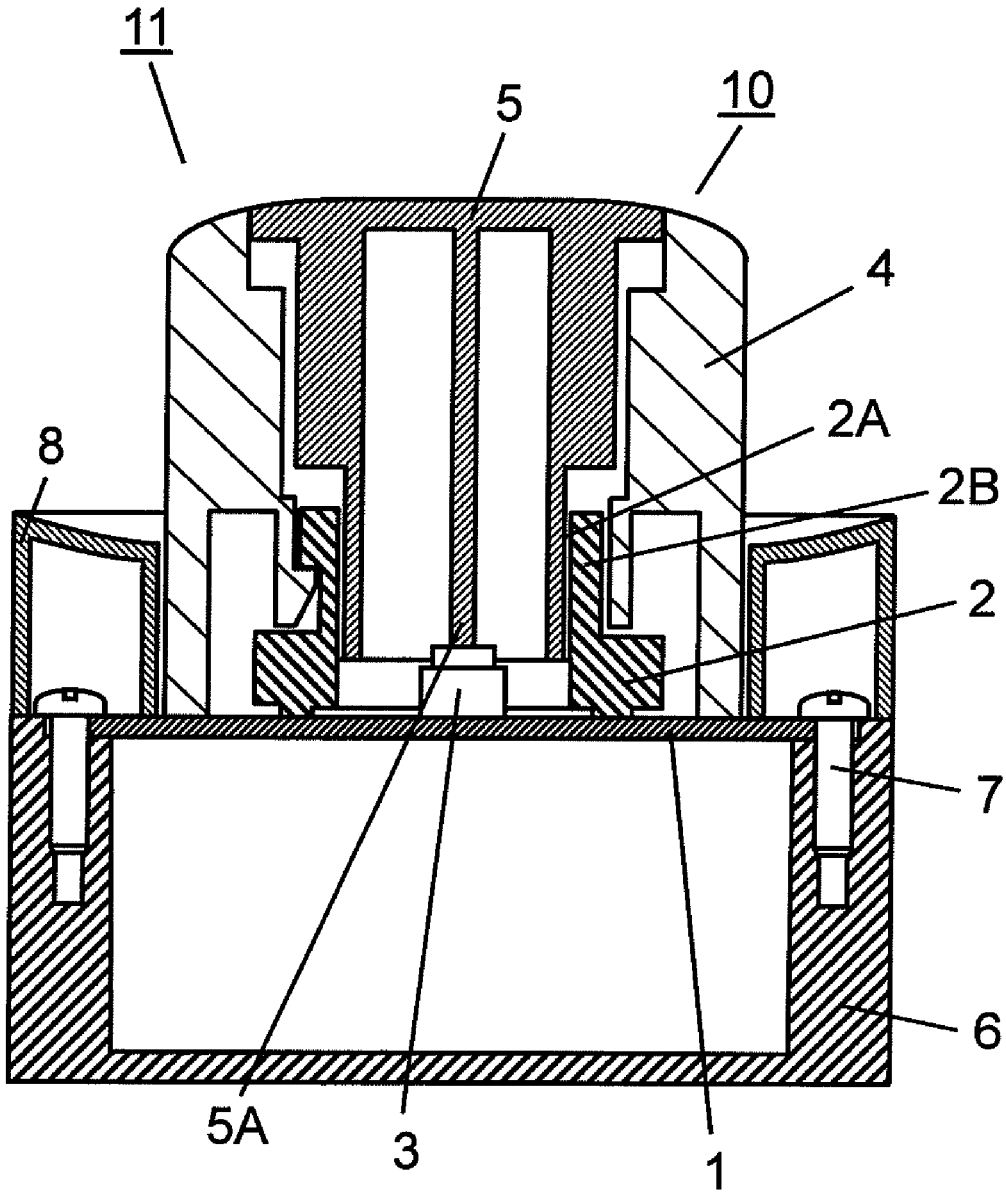
FIG. 13 shows a sectional view of a conventional vehicle switch.
Figure 14:
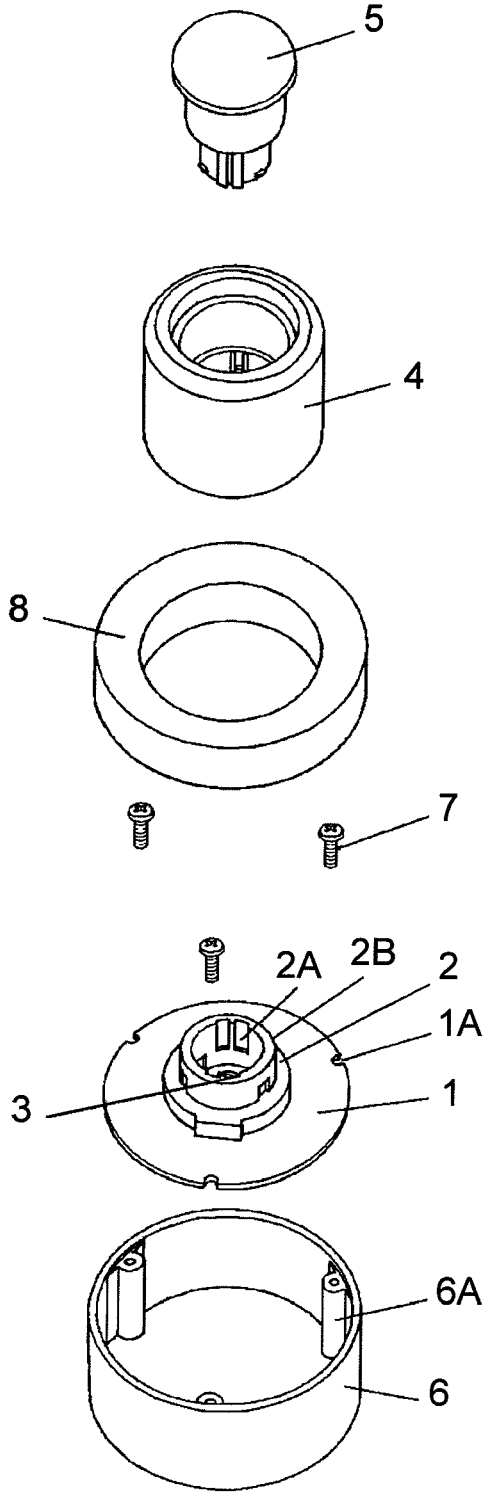
FIG. 14 shows an exploded perspective view of the vehicle switch shown in FIG. 13.
Figure 15A:
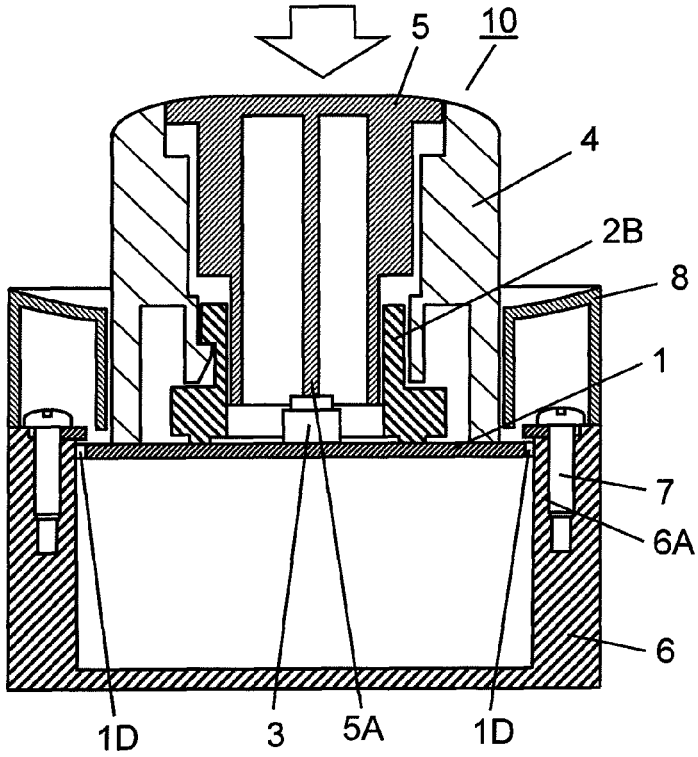
FIGS. 15A and 15B show sectional views illustrating operation of the vehicle switch shown in FIG. 13.
Figure 15B:
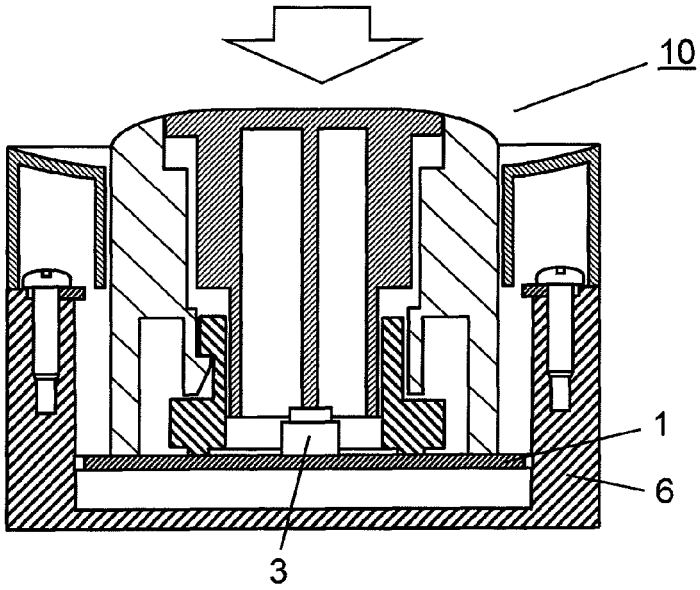
Figure 16A:
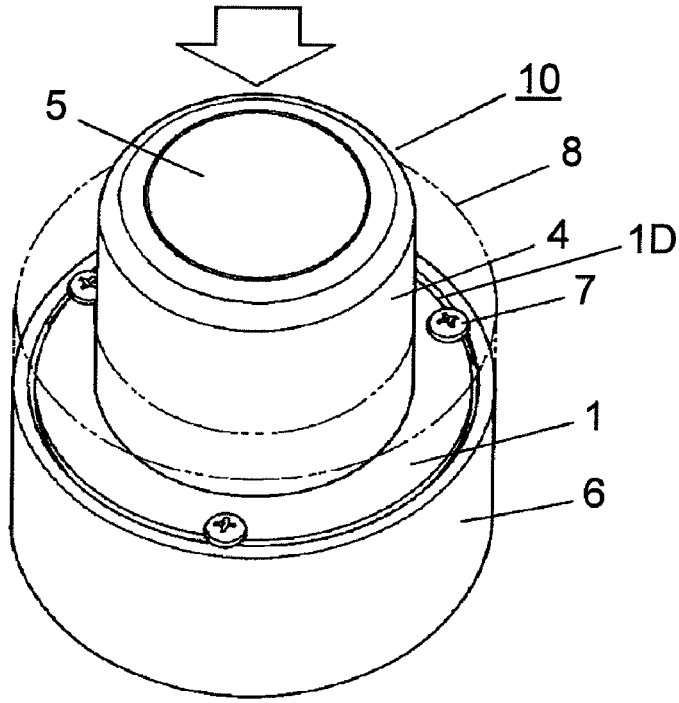
FIGS. 16A and 16B show perspective views illustrating operation of the vehicle switch shown in FIG. 13.
Figure 16B:
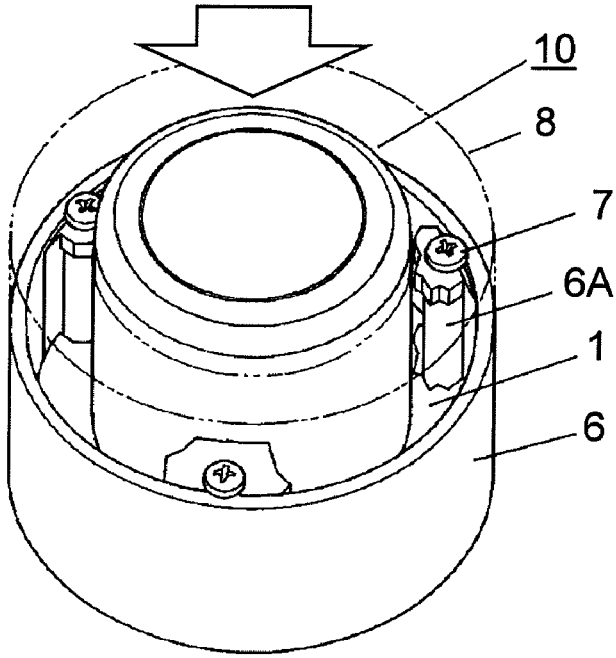

The operation of vehicle switch 51 is demonstrated hereinafter with reference to FIGS. 11A-12A. FIGS. 11A and 11B show lateral sectional views illustrating the status of vehicle switch 51 to which a shock is applied. FIGS. 12A and 12B show perspective views illustrating a normal status of vehicle switch 51 and a status thereof where a shock is applied.

To be more specific, when baggage in the car interior hits operating unit 4 or push button 5, and a load or a shock greater than a given force is applied to operating unit 4 or push button 5, the status of vehicle switch 5 is changed from the normal one as shown in FIG. 8 or FIG. 12A to the status where wiring board 42 of switch unit 50 is depressed downward. This depression entails bending of engaging sections 47C of support-board 47, which support wiring board 42, as shown in FIG. 11A, i.e. engaging sections 47C are guided by slant faces 46C slanting inward of the stopper recesses 46B, and are elastically deformed inward and bent downward as shown with white and narrow arrow marks. As a result, the load or the shock applied to encoder 2, push switch 3 and wiring board 42 can be alleviated.

If a force greater than 20 kgf is applied thereto, engaging sections 47C override the lower ends of slant faces 46C of stopper recesses 46B and move to slant faces 46D slanting outward, so that engaging sections 47C come off stopper recesses 46B. Then switch unit 50 together with support-board 47 lowers into a space within housing 46 as shown in FIGS. 11B and 12B. As a result, this structure prevents encoder 2, push switch 3 and wiring board 42 from being damaged.

To be more specific, during a normal operation such as a push onto push button 5 or a rotation of operating unit 4, switch unit 50 is supported, via wiring board 42, by supporting member 49 formed of support-board 47 and support spring 48, so that no problems occur during the normal operation. However, when a great force is applied to switch unit 50 as a load or a shock, supporting member 49, which supports wiring board 42, is elastically deformed for alleviating the load or shock. If the greater force is applied thereto, supporting member 49 is further deformed elastically, so that the support to wiring board 42 by supporting member 49 is released. As a result, switch unit 50 lowers into the space within housing 46 free from being damaged.

Since switch unit 50 is brought into contact with flat support-face 47A of support-board 47 for being supported, wiring board 42 resists bending downward by a push onto push button 5 or a rotation of operating unit 4 in a regular manner. The driver can thus operate vehicle switch 51 with a stable operating feel.

In the third embodiment discussed above, wiring board 42 of switch unit 50 accommodated in box-shaped housing 46 is supported by supporting member 49 elastically deformable and held by housing 46 and formed of support spring 48 and support-board 47. When a great load or shock is applied to operating unit 4 or push button 5, this structure allows supporting member 49, which supports wiring board 42, to deform elastically inward for alleviating the load or the shock. If the greater load or shock is applied thereto, the foregoing structure releases the hold of supporting member 49 by housing 46, so that switch unit 50 together with supporting member 49 lowers into housing 46. As a result, the switch contacts of encoder 2 and push switch 3, and wiring board 42 can avoid the greater load or shock, so that this structure prevents these structural elements from being damaged. Similar to the first and the second embodiments, this third embodiment can provide vehicle switch 51 having reliable operation.

This third embodiment refers to supporting member 49 as being formed of support-board 47 and support spring 48 mounted inside support-board 47; however, another structure of supporting member 49 is available, i.e. support-board 47 made of insulating resin is reinforced such that it can be elastically deformed by a force greater than a given value, so that this support-board 47 can work as supporting member 49 by itself. Then it is elastically held by housing 46, thereby supporting the wiring board 42 of switch unit 50. This structure can produce an advantage similar to what is discussed previously.

The descriptions discussed previously refer to support springs 27, 37, 48 made of elastic metal wire such as hard steel wire, piano wire, or stainless steel wire; however, they can be formed of plate-like elastic metal plate such as stainless steel plate, or copper alloy metal sheet to be used for the springs.

The previous descriptions refer to the structure where discrete rotary encoder 2 and push-switch 3 are mounted on the wiring board for forming switch contacts; however, the switch contacts can be formed this way: multiple and annular fixed contacts are formed of carbon on the top face of the wiring board, and brush-like movable contacts are formed on the underside of operating unit 4, and then these movable contacts and fixed contacts carry out an electrical switch-on or switch-off in response to a rotary operation of the operating unit 4. This structure produces an advantage similar to what is discussed previously.

Here is another structure: multiple fixed contacts are formed on the top face of the wiring board, and domed movable contacts made of conductive thin metal sheet are placed above the fixed contacts, and then a push onto push button 5 prompts the fixed and the movable contacts to carry out an electrical switch-on or switch-off. This structure also produces an advantage similar to what is discussed previously. The present invention thus can be implemented by using a variety of switch contacts.

What is claimed is:

1. A vehicle switch comprising:

a switch unit including a wiring board and an operating unit disposed over the wiring board;

a housing accommodating the wiring board; and an elastically deformable supporting member disposed to the housing for releasable supporting the wiring board in a supported position;

wherein the supporting member is configured to elastically support the wiring board, with respect to the housing, against a force imposed on the wiring board so long as the force is at or below a given force value and, when the force is above the given force value, releasing support of the wiring board such that the wiring board is moved out of the supported position to a location in which the wiring board is not supported by the supporting member.

2. The vehicle switch of claim 1, wherein the supporting member is held by a fixing section provided to the housing.

3. The vehicle switch of claim 2, wherein the supporting member is formed of a support-board supporting the wiring board, a support spring mounted to the support-board, wherein the supporting member is disposed in the housing and the support-board is held by the fixing section.

4. The vehicle switch of claim 2, wherein the supporting member is formed of a support spring including a supporter shaped like letter U and a holder disposed at both ends of the supporter and bent downward, wherein the supporting member is disposed in the housing and the supporter supports the wiring board, and the fixing section holds the holder.

5. The vehicle switch of claim 2, wherein the supporting member includes a support spring formed of a supporter and a holder disposed at both ends of the supporter, wherein the supporting member is disposed out of the housing and the supporter supports the wiring board, and the fixing section holds the holder.

6. The vehicle switch of claim 1, wherein the supporting member is formed of a support spring.

7. The vehicle switch of claim 6, wherein the supporting member supports the wiring board at a lower part of the board.

8. The vehicle switch of claim 1, wherein the supporting member is configured such that, when the force is above the given force value, the supporting member elastically deforms by an amount that allows the wiring board to move from the supported position past the supporting member toward the location in which the wiring board is not supported by the supporting member.

9. The vehicle switch of claim 1, wherein the supporting member is fixed to the housing, and the wiring board is elastically supported on the supporting member.

10. The vehicle switch of claim 1, wherein wiring board is mounted on the supporting member, and the supporting member is elastically supported on a portion fixedly provided on the housing.

11. The vehicle switch of claim 1, wherein the supporting member comprises a plurality of spaced apart supporting elements.

12. The vehicle switch of claim 11, wherein the plurality of supporting elements are spaced at intervals about the switch unit.

13. The vehicle switch of claim 11, wherein the supporting elements comprise U-shaped support springs, each including a supporter part and a pair of holder legs extending from opposite ends of the supporter part, and for each of the support springs, the holder legs are fixed to the housing.

14. The vehicle switch of claim 13, wherein the housing has, for each of the support springs, a pair of holder holes in which the holder legs are respectively disposed.

15. The vehicle switch of claim 13, wherein the support springs are spaced at intervals about the switch unit and, for each of the support springs, the supporter part projects inwardly from the holder legs toward the switch unit and is arranged such that, when the force is above the given force value, the supporter part deforms downwardly in a direction in which the wiring board moves from the supported position to the location in which the wiring board is not supported by the supporting member.

16. The vehicle switch of claim 13, wherein the support springs are spaced at intervals about the switch unit and, for each of the support springs, the supporter part projects outwardly from the holder legs away from the switch unit and is arranged such that, when the force is above the given force value, the supporter part deforms outwardly in a direction away from the switch unit.

17. The vehicle switch of claim 11, wherein the supporting member is constituted by a circumferentially-extending support spring coupled with a support board;

the housing is provided with fixing sections respectively including inwardly projecting portions projecting inwardly from the housing;

the supporting member includes outwardly projecting portions respectively constituting said spaced apart supporting elements; and the outwardly projecting portions are elastically supported on the inwardly projecting portions of the fixing sections, respectively.

* * * * *